US006227545B1

(12) United States Patent
Kugler

(10) Patent No.: US 6,227,545 B1
(45) Date of Patent: May 8, 2001

(54) HEATABLE AND/OR COOLABLE CYLINDER

(75) Inventor: Georg Kugler, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/179,199

(22) Filed: Oct. 27, 1998

(30) Foreign Application Priority Data

Oct. 28, 1997 (DE) ..... 197 47 555

(51) Int. Cl.[7] ..... F01D 11/02
(52) U.S. Cl. ..... 277/306; 277/355; 34/124
(58) Field of Search ..... 277/355, 306, 277/390, 930; 34/124, 125

(56) References Cited

U.S. PATENT DOCUMENTS

| | | | | |
|---|---|---|---|---|
| 885,032 | | 4/1908 | De Ferranti . | |
| 2,365,271 | | 12/1944 | Hornbostel . | |
| 2,413,567 | | 12/1946 | Hornbostel . | |
| 2,542,287 | | 2/1951 | Neubauer . | |
| 2,643,099 | * | 6/1953 | Kinraide et al. | 34/124 |
| 2,911,234 | | 11/1959 | Hieronymus . | |
| 2,978,815 | * | 4/1961 | Hieronymus | 34/124 |
| 3,582,231 | * | 6/1971 | Zerlauth | 415/135 |
| 4,501,075 | * | 2/1985 | Jenkner et al. | 34/125 |
| 4,989,919 | * | 2/1991 | Greer | 300/10 |
| 5,071,138 | * | 12/1991 | Mackay et al. | 277/355 |
| 5,090,710 | | 2/1992 | Flower . | |
| 5,230,169 | | 7/1993 | Jaatinen et al. . | |
| 5,308,434 | | 5/1994 | Hieronymus et al. . | |
| 5,474,305 | * | 12/1995 | Flower | 277/355 |
| 5,864,963 | * | 2/1999 | Komulainen | 34/124 |

FOREIGN PATENT DOCUMENTS

| | | |
|---|---|---|
| 398611 | 7/1924 | (DE) . |
| 2553447 | 6/1977 | (DE) . |

(List continued on next page.)

*Primary Examiner*—Anthony Knight
*Assistant Examiner*—Alison K. Pickard
(74) *Attorney, Agent, or Firm*—Greenblum & Bernstein, P.L.C.

(57) ABSTRACT

Cylinder that includes at least one stationary portion and at least one rotatable portion and a support and a method for sealing the same. The at least one rotatable portion includes a bearing axle rotatably coupled to the support, and the at least one stationary portion includes at least one stationary connection that is rotatably coupled to the bearing axle and that is adapted for at least one of inserting and removing at least one of a heating and cooling medium through the bearing axle. The cylinder also includes a sealing device that is composed of at least one brush seal and that is positioned between the at least one stationary portion and the at least one rotatable portion. The method includes rotatably coupling a bearing axle of a rotatable cylinder to a support. The bearing axle is fixedly coupled to a rotatable member and includes a channel adapted for at least one of insertion and removal of at least one of a heating and a cooling medium through the bearing axle. The method also includes coupling at least one stationary connection to the bearing axle for relative rotation, and positioning at least one brush seal between the at least one stationary connection and the rotatable member.

39 Claims, 3 Drawing Sheets

FOREIGN PATENT DOCUMENTS

| | | |
|---|---|---|
| 30 09 810 | 10/1980 | (DE) . |
| 8314025 | 3/1984 | (DE) . |
| 3417093 | 11/1985 | (DE) . |
| 3425162 | 1/1986 | (DE) . |
| 3511903 | 10/1986 | (DE) . |
| 8412129 | 2/1987 | (DE) . |
| 37345524 | 4/1989 | (DE) . |
| 4106368 | 9/1992 | (DE) . |
| 4230920 | 5/1993 | (DE) . |
| 4337944 | 5/1994 | (DE) . |
| 19519322 | 11/1996 | (DE) . |
| 19538236 | 4/1997 | (DE) . |
| 19603011 | 7/1997 | (DE) . |
| 197 00 139 | 7/1997 | (DE) . |
| 19609214 | 9/1997 | (DE) . |
| 19618661 | 10/1997 | (DE) . |
| 0499597 | 8/1992 | (EP) . |

* cited by examiner

HEATABLE AND/OR COOLABLE CYLINDER

CROSS-REFERENCE TO RELATED APPLICATIONS

The present application claims priority under 35 U.S.C. § 119 of German Patent Application No. 197 47 555.8, filed on Oct. 28, 1997, the disclosure of which is expressly incorporated by reference herein in its entirety.

BACKGROUND OF THE INVENTION

1. Field of the Invention

The present invention relates to a heatable and/or coolable cylinder having a bearing axle pivotably mounted in a support and at least one stationary connection, the at least one stationary connection being coupled to the bearing axle for input and/or removal of at least one of heating and/or cooling medium through the at least one stationary connection and the bearing axle. A sealing device is provided between a rotating portion, e.g., a rotating cylinder body, the bearing axle, and/or at least one part rotating therewith, and a stationary portion, e.g., the support, the at least one stationary connection, and/or at least one other stationary part.

2. Discussion of the Background Information

In known cylinders, such as disclosed in, e.g., EP 0 499 597 B1 and DE 197 00 139 A1, sealing between a flange that is solidly coupled to the bearing axle and the stationary connection is provided by a piston ring with a carbon gasket that is mounted to be axially movable in the stationary connection and pressed against an annular sealing surface of the flange associated with the bearing axle. Pressure is generally applied by springs, and is reinforced by vapor pressure prevailing within the cylinder.

The temperature-associated allowances between the parts to be coupled to each other are compensated by such sealing.

However, due to the wear on the carbon seal that occurs during operation, it is essential that the condition of the seal be monitored. Consequently, seals such as these are generally only suitable for use between axially oriented sealing surfaces, i.e., sealing surfaces lying in a specific radial plane.

In addition to the relatively high axial forces acting on the bearing of the cylinder and the relatively fast wear, sealing arrangements in the prior art have the disadvantage of relatively expensive design.

Moreover, known radial sealing rings are inadequate or unusable due to the usual temperatures in dryer cylinders of paper or cardboard producing machines, e.g., between approximately 80 and 230° C.

SUMMARY OF THE INVENTION

The present invention provides a heatable and/or coolable cylinder of the type generally discussed above in which an essentially wear-resistant and reliable sealing is substantially ensured as simply as possible.

The present invention provides a sealing device that includes at least one brush seal positioned between a rotating sealing surface and a stationary sealing surface.

A brush seal may be composed of, e.g., a bundle of wires held together by a holder. The wires may, in particular, be made of metal, but may also be made of a different material. The holder may be positioned against one sealing surface, while the other sealing surface is coupled to the ends of the wires. The bundles of wires not only provide adequate sealing, they are more wear-resistant than carbon seals.

Further, the bundle of wires is flexible so that it may, in particular, be installed under tension. In this manner, temperature-associated allowances between the sealing surfaces may be compensated for. Thus, additional arrangements to apply pressure are no longer necessary.

The sealing device may include at least one brush seal that is positioned between radially oriented sealing surfaces. Additionally, or alternatively, at least one brush seal may be positioned between axially oriented sealing surfaces.

Expediently, at least one annular brush seal that is particularly advantageous in light of the presence of a specific rotating sealing surface may be provided.

In an exemplary embodiment of the cylinder according to the present invention, the bearing axle has, in a region for conveying the heating and/or cooling medium, a cylindrical bore. A cylindrical pipe may be rotatably inserted within the cylindrical bore to rotate with the bearing axle. The cylindrical pipe may, preferably, serve as a protective pipe and be surrounded in an end region located outside of the bearing axle by the stationary connection.

In the exemplary embodiment, the brush seal may be located between an outer surface of the end region of the cylindrical pipe and the stationary connection. However, it is possible to position the brush seal between the stationary connection and a bushing rotating with the bearing axle and surrounding the end region of the cylindrical pipe.

If the brush seal is positioned directly between the outer surface of the end region of the cylindrical pipe and the stationary connection, a bushing, which rotates with the bearing axle and surrounds the end region of the cylindrical pipe, may advantageously be axially located between the brush seal and the adjacent end of the bearing axle.

Sealing may be simplified through the use of a cylindrical pipe having an end region that is surrounded by the stationary connection and that rotates with the bearing axle. Allowances between the sealing surfaces may be compensated by the flexible brush seal. Thus, no additional device is necessary to press the seal against a sealing surface.

The space between the bearing axle and the pipe rotating therewith may preferably be sealed relative to the outside by the specific bushing.

The sealing device includes at least one brush seal that may generally be provided between the rotating cylinder body, the bearing axle, and/or at least one part rotating therewith and the support, the connection, and/or at least one other stationary part. The sealing device may include at least one brush seal that is located between the bearing axle or a part rotating therewith and a stationary connection or a part solidly connected thereto. Here, a specific brush seal may be disposed between radially oriented sealing surfaces or between axially oriented sealing surfaces. In principle, a combination of such seals is also possible.

In an advantageous embodiment, at least one brush seal, which is prestressed when it is placed between the sealing surfaces, is provided.

In principle, it is also conceivable to provide, in addition to the at least one brush seal, at least one other (i.e., different) type of seal.

If steam is utilized as the heating medium, devices may preferably be provided to remove condensate appearing in the region of a specific brush seal.

It is particularly advantageous if at least one channel, utilized to input steam, runs through the cylindrical bore of the bearing axle. The channel may open into the interior of the cylinder and may run outwardly through the stationary connection.

Alternatively, or additionally, at least one stationary channel, utilized for the removal of water, steam, and/or condensate, may run through the cylindrical bore of the bearing axle. The channel may open into the interior of the cylinder and may run outwardly through the stationary connection.

In an advantageous practical embodiment of the cylinder according to the present invention, one of the two channels may be a stationary ring channel surrounding the other stationary channel. Thus, the channel utilized to input steam may be provided, e.g., as a stationary ring channel.

Accordingly, on at least one roller end, an appropriate stationary connection may be provided for both the input of steam and the removal of water, steam, and/or condensate.

In an advantageous alternative embodiment, only one channel for the input of steam may run through the cylindrical bore in the bearing axle positioned on one of the two ends of the roller. The channel may open into the interior of the cylinder and may run outwardly through the stationary connection.

It is also possible to position, preferably, only one stationary channel, e.g., for removal of water, steam, and/or condensate, through the cylindrical bore of the bearing axle positioned on one of the two ends of the roller. The stationary channel may also open into the interior of the cylinder and may run outwardly through the stationary connection.

In an expedient practical embodiment, a channel for the input of steam, as well as a corresponding stationary connection for the input of steam, may be provided on one of the two ends of the roller. Moreover, a stationary channel for removal of water, steam, and/or condensate and a corresponding, preferably, stationary connection for removal of water, steam, and/or condensate may be provided on the other end of the roller.

It may be particularly advantageous if the stationary channel(s) passing through the bearing axle run(s) inside the cylindrical pipe that rotates with the bearing axle within the cylindrical bore.

The additional channel(s) may further simplify the overall seal with respect to the rotating part(s).

In the exemplary embodiment, the bearing axle may include an expansion shaft on each of the two respective ends of the roller.

The cylinder according to the present invention may be utilized, e.g., as a dryer cylinder, a press roller, or a glazing cylinder in a machine for the production and/or treating of paper or cardboard, textile, or other fiber webs.

The present invention is directed to a cylinder that includes at least one stationary portion and at least one rotatable portion and a support. The at least one rotatable portion includes a bearing axle rotatably coupled to the support, and the at least one stationary portion includes at least one stationary connection that is rotatably coupled to the bearing axle and that is adapted for at least one of inserting and removing at least one of a heating and cooling medium through the bearing axle. The cylinder also includes a sealing device that is composed of at least one brush seal and that is positioned between the at least one stationary portion and the at least one rotatable portion.

In accordance with another feature of the present invention, the at least one rotatable portion may also include a cylindrical pipe and a bushing coupled to the bearing axle. The sealing device may be positioned between the at least one stationary connection and one of the cylindrical pipe and the bushing.

The present invention is also directed to a method for sealing an end of a cylinder. The method includes rotatably coupling a bearing axle of a rotatable cylinder to a support. The bearing axle is fixedly coupled to a rotatable member and includes a channel adapted for at least one of insertion and removal of at least one of a heating and a cooling medium through the bearing axle. The method also includes coupling at least one stationary connection to the bearing axle for relative rotation, and positioning at least one brush seal between the at least one stationary connection and the rotatable member.

In accordance with another feature of the present invention, the rotatable member includes a cylindrical pipe inserted into a cylindrical bore in the bearing axle, and an end of the cylindrical pipe extends beyond an axial extent of the bearing axle opposite the rotatable cylinder. The method further includes surrounding the end of the cylindrical pipe with the at least one stationary connection, and positioning the at least one brush seal between the at least one stationary connection and the end of the cylindrical pipe. The method further includes surrounding the end of the cylindrical pipe with a bushing, and sealing an outside surface of the end of the cylindrical pipe to the bearing axle with the bushing. The method may further include positioning the at least one brush seal between the at least one stationary connection and the bushing, or may further include positioning the at least one brush seal directly between the at least one stationary connection and the outside surface of the cylindrical pipe.

In accordance with still another feature of the present invention, the method further includes inserting steam into the rotatable cylinder through at least a portion of the at least one stationary connection and through the bearing axle.

In accordance with yet another feature of the present invention, the method further including removing at least one of water, steam, and condensate from the rotatable cylinder through the bearing axle and through at lease a portion of the at least one stationary connection. The method also includes inserting steam into the rotatable cylinder through at least a portion of the at least one stationary connection and through the bearing axle. Further, the inserting and removing may be performed at a same end of the rotatable cylinder, or the inserting and removing may be performed at opposite ends of the rotatable cylinder.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
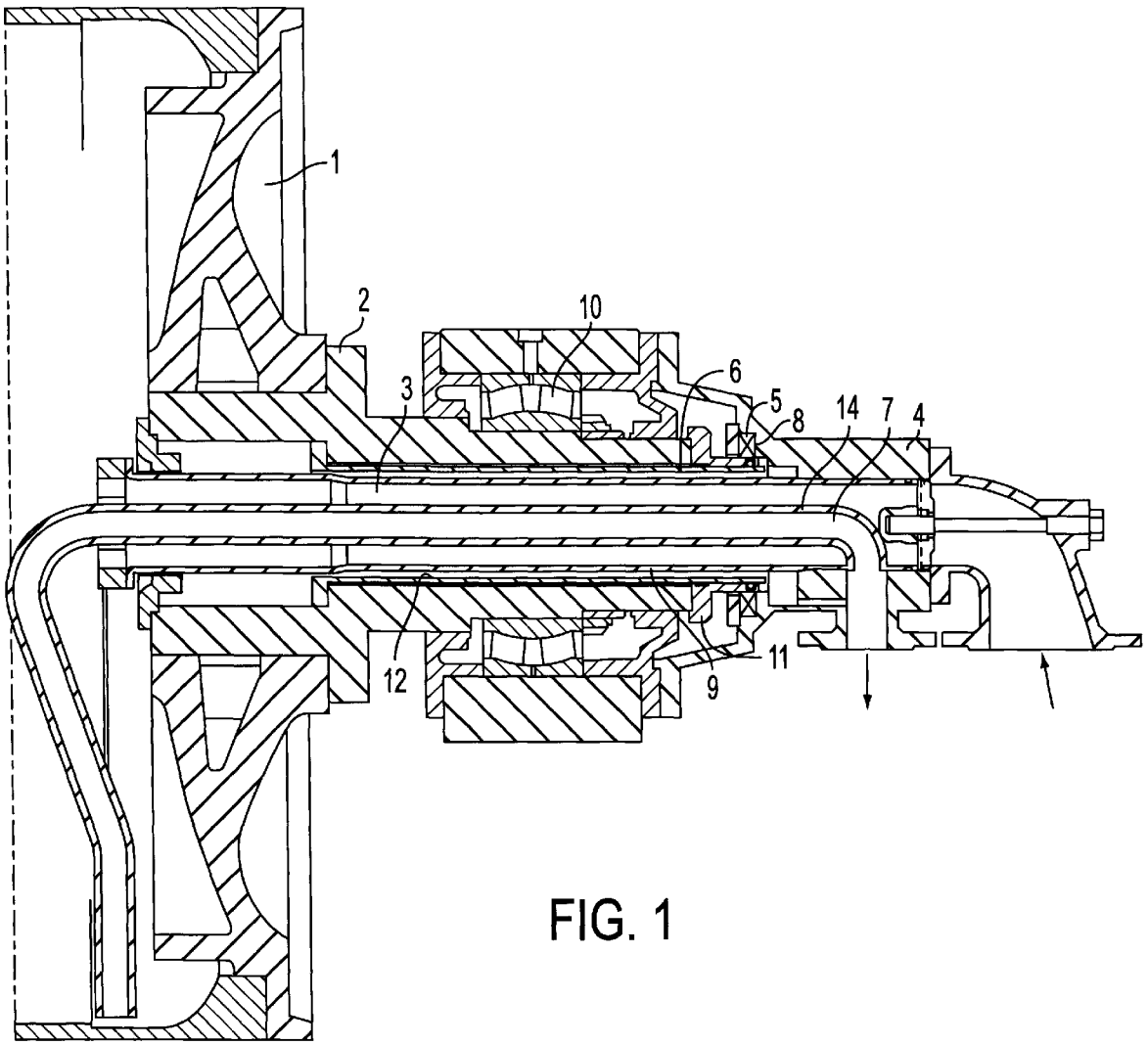
FIG. 1 schematically illustrates a sectional view of one end of a cylinder of the present invention with a stationary connection for both input and removal of a heating and/or cooling medium.
Figure 2:
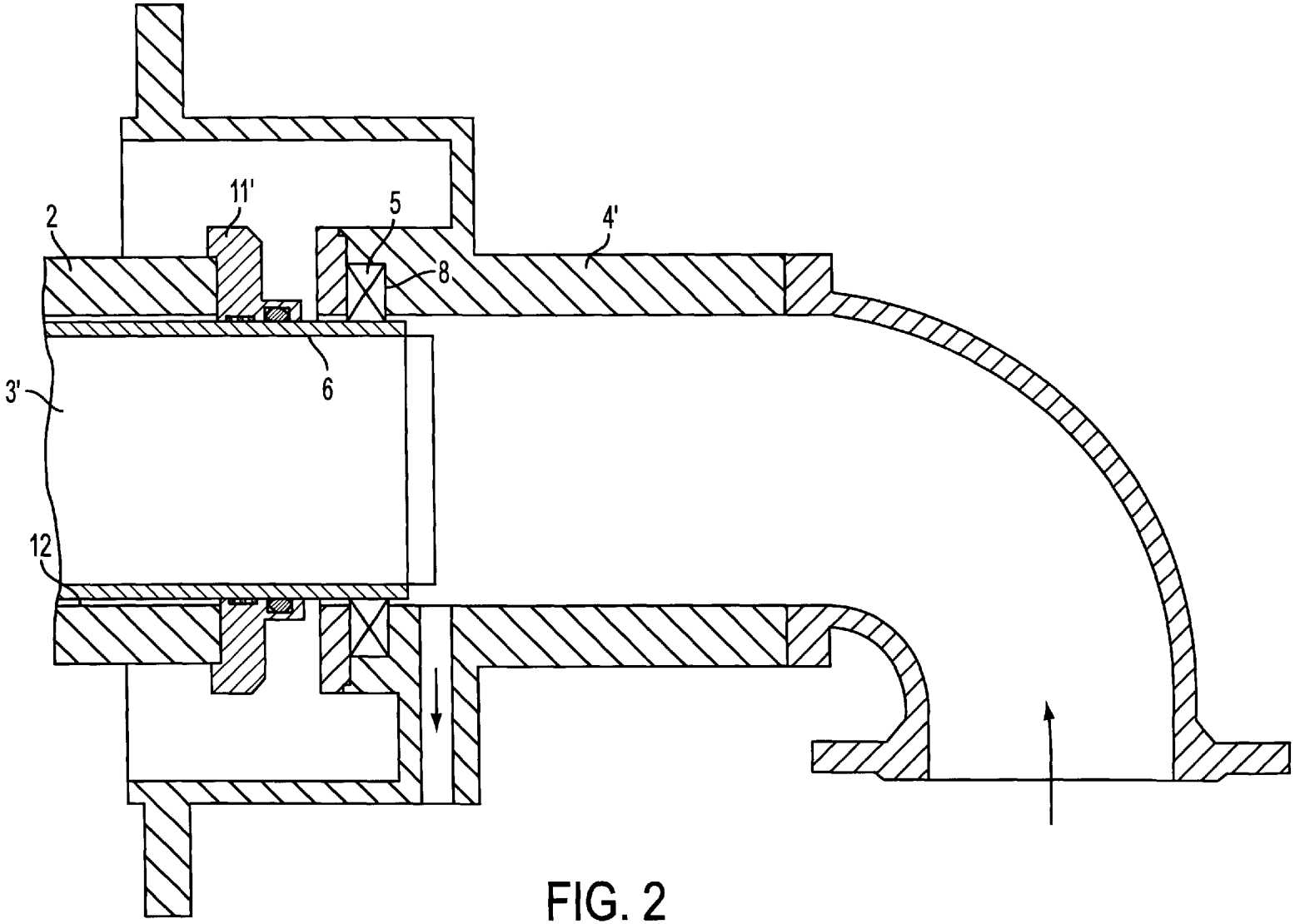
FIG. 2 schematically illustrates a sectional view of one end of an alternative embodiment of the cylinder of the present invention with a stationary connection for input of the heating and/or cooling medium.
Figure 3:
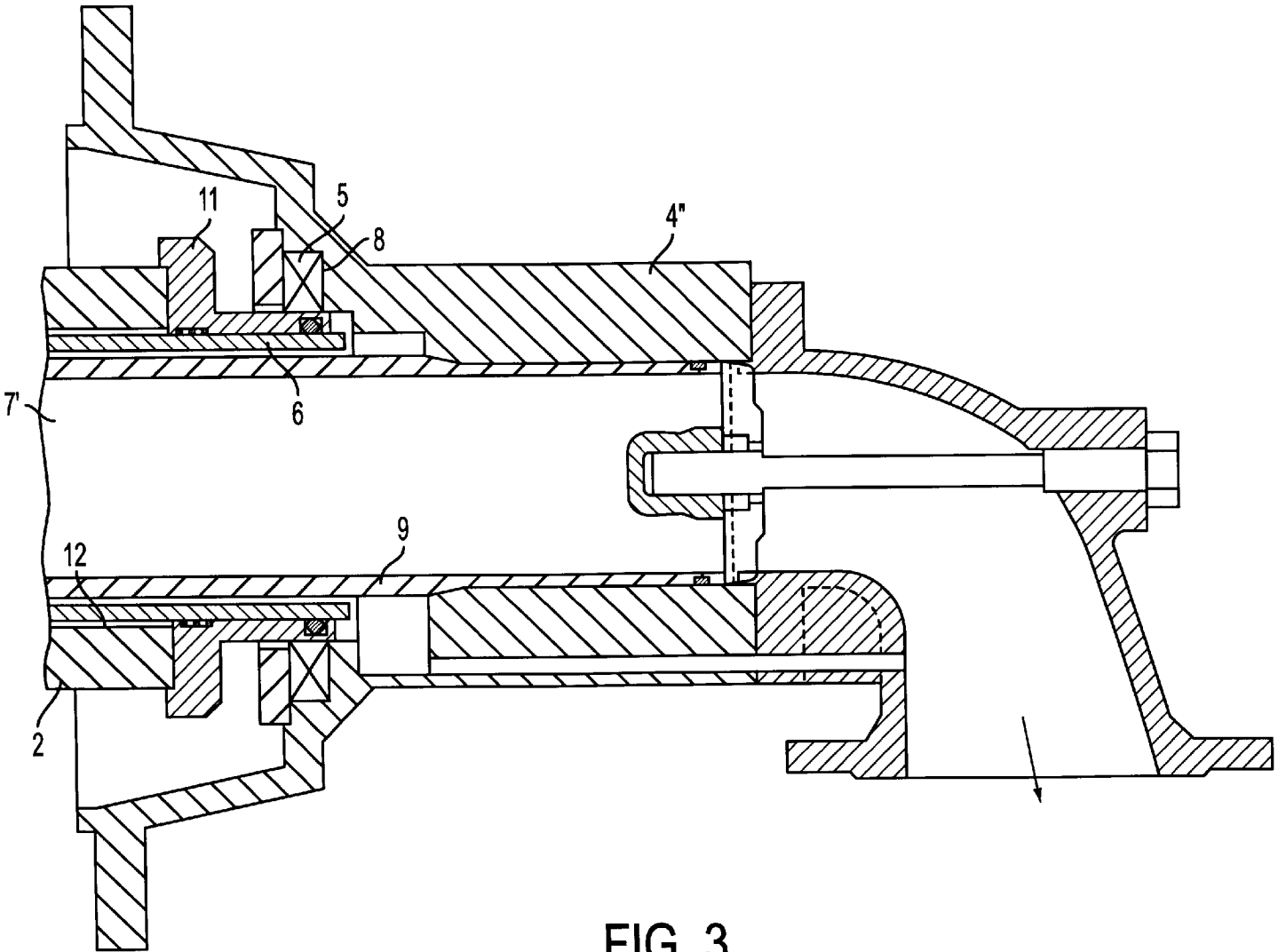
FIG. 3 schematically illustrates a sectional view of one end of another alternative embodiment of the cylinder of the present invention with a stationary connection for removal of the heating and/or cooling medium.

FIGS. 1–3 schematically illustrate one end of a cylinder, which may be at least one of a heatable and a coolable cylinder, e.g., a dryer cylinder. The cylinder may include a stationary connection 4 (or 4' or 4" as illustrated in FIGS. 2 and 3, respectively) and a bearing axle 2 that is pivotably mounted in a support of the paper machine. Stationary connection 4 and bearing axle 2 may be provided on the ends of the roller as an extension shaft.

Stationary connection 4 may be fixedly coupled to the support and may be coupled to bearing axle 2 for relative rotation. Bearing axle 2 may include a cylindrical bore 12 that is provided so that a medium, e.g., a heating and/or cooling medium, can be input or removed through stationary connection 4 and bearing axle 2. In the exemplary embodiment, a heating medium, e.g., hot steam, may be utilized. Accordingly, stationary connection 4, which is depicted in FIG. 1, is utilized for the input of steam and for the removal of water, steam, and/or condensate, as indicated by the directional arrows. Stationary connection 4', which is depicted in FIG. 2, may be utilized merely for the input of steam; and stationary connection 4", which is depicted in FIG. 3, may be utilized only for the removal of water, steam, and/or condensate.

A rotating cylinder body 1 may be fixedly coupled to bearing axle 2. Further, bearing axle 2 may be fixedly coupled to another element, such as a cylindrical pipe 6 positioned within cylindrical bore 12 and/or a bushing 11 (or 11'). Stationary connection 4 may be fixedly coupled, not only to the support, but to another stationary part.

A sealing device may be provided between the rotating parts, e.g., rotating cylinder body 1, bearing axle 2, and/or rotating parts 6, and/or 11 (or 11'), and the stationary parts, e.g., the support, stationary connection 4 (or 4' or 4"), and/or another stationary part. In the exemplary embodiment, the sealing device may be an annular brush seal 5 that is composed of a bundle of wires held together by a holder. The wires may be made of, e.g., metal, but may also be made of another material known to those ordinarily skilled in the art in keeping with the features of the present invention.

In each of the illustrated exemplary embodiments, cylindrical pipe 6, which is fixedly mounted for rotation with bearing axle 2, may be utilized as a protective pipe within cylindrical bore 12 of the bearing axle 2. Cylindrical pipe 6 may protect a bearing 10, which is located in a region of a extension shaft of bearing axle 2, from excessively high temperatures. Cylindrical pipe 6 may include an end region that is surrounded by stationary connection 4, which may be axially separated from bearing axle 2. At this end region of cylindrical pipe 6, annular brush seal 5 may be positioned between an outer surface of cylindrical pipe 6 and stationary connection 4.

In the exemplary embodiment depicted in FIG. 1, a bushing 11 may be positioned around, and fixedly mounted to the end region of cylindrical pipe 6 and to an axial end of bearing axle 2. In this manner, brush seal 5 may be located between stationary connection 4 and bushing 11.

In the exemplary embodiment according to FIG. 2, brush seal 5 may be positioned directly between the outer surface of the end region of cylindrical pipe 6 and stationary connection 4'. A bushing 11', fixedly mounted for rotation with bearing axle 2 and surrounding the end region of cylindrical pipe 6, may be axially located between brush seal 5 and the axial end of bearing axle 2.

In the exemplary embodiment depicted in FIG. 3, brush seal 5 may be positioned, in a manner similar to that depicted in FIG. 1, between bushing 11 and the stationary connection 4".

The holder of a specific brush seal 5 may be mounted or set into a recess 8 of stationary connection 4. The free ends of the wires of brush seal 5 may extend toward radially inwardly to make contact with the outer surface of cylindrical pipe 6, as illustrated in FIG. 2, and to make contact with bushing 11, as illustrated in FIGS. 1 and 3.

Brush seal 5 may be, and is preferably, mounted under tension so that the contact between stationary connection 4 and either cylindrical pipe 6 or bushing 11 is adequately elastic to compensate or allow for variances, e.g., radial distances, between stationary and rotating elements being sealed. In this manner, optimal sealing action is substantially always maintained. Moreover, the wires of brush seal 5, when made of, e.g., metal, have a clearly reduced wear when compared to the carbon seals utilized in the prior art. Thus, expensive devices or arrangements for pressing the seal against an opposing sealing surface may be substantially eliminated.

In each of the above-mentioned exemplary embodiments, the radial space between bearing axle 2 and cylindrical pipe 6 is sealed by bushing 11 (or 11'), which rotates with bearing axle 2 and cylindrical pipe 6. Moreover, it may be advantageous if, in addition to, or as an alternative to, the above-discussed sealing device, brush seal 5 may be positioned between bearing axle 2 and stationary connection 4.

To maintain as optimum a connection of brush seal 5 as possible, condensate appearing in the region of the free ends of the wires may be removed.

In the embodiment depicted in FIG. 1, a stationary channel 3, which is utilized to input steam, and a stationary channel 7, which is utilized to remove water, steam, and/or condensate, may be arranged to extend through cylindrical bore 12 of bearing axle 2. Further, stationary channels 3 and 7 may be arranged to extend through cylindrical pipe 6, which rotates with bearing axle 2, inwardly into the interior of the cylinder and outwardly through stationary connection 4. Further, stationary channel 3 may be a ring channel arranged to surround stationary channel 7. In this manner, the condensate appearing in the region of brush seal 5 may be diverted or guided into stationary channel 7 for removal through stationary connection 4.

In the embodiment depicted in FIG. 2, only one channel 3', which is provided for the input of steam, extends through cylindrical bore 12 of bearing axle 2. Channel 3' may be bounded in the exemplary illustration by the interior surface of cylindrical pipe 6 to open into the interior of the cylinder, and to extend outwardly through stationary connection 4'.

The removal of water, steam, and/or condensate may be performed at the opposite end of the cylinder, e.g., in an arrangement such as depicted in FIG. 3.

In this embodiment, only one stationary channel 7', which is provided for the removal of water, steam, and/or condensate, may extend through cylindrical bore 12 of bearing axle 2. Channel 7' may be bounded in the exemplary illustration by a stationary pipe socket 9 fixedly coupled to stationary connection 4" to open into the interior of the cylinder and to extend outwardly through stationary connection 4". In this embodiment, as well as the embodiment depicted in FIG. 1, pipe socket 9 is fixedly coupled to stationary connection 4 and extends into rotatably cylindrical pipe 6. However, in contrast to the embodiment shown in FIG. 1, in the FIG. 3 embodiment, at least a portion of channel 7' is formed by stationary pipe socket 9. In FIG. 1, the annular channel 3 is formed between pipe socket 9 and a pipe 14 forming the inner stationary channel 7. However, in both embodiments, stationary pipe socket 9 is substantially coaxially positioned within cylindrical pipe 6.

In the exemplary embodiment depicted in FIG. 2, removal of condensate from the region of brush seal 5 may be performed, e.g., outwardly and directly through stationary connection 4', as depicted by the outwardly directed arrow. In contrast, in the embodiment according to FIG. 3, a connection to stationary channel 4" may be provided for removal of water, steam, and/or condensate.

The above-described cylinder may be utilized as, e.g., a drying cylinder, a press roller, or a glazing cylinder in a machine for the production and/or treatment of paper or cardboard, textile, or other fiber webs.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

1 rotating cylinder body
2 bearing axle
3 stationary channel
3' channel
4 stationary connection
4' stationary connection
4" stationary connection
5 brush seal
6 rotating cylindrical pipe
7 stationary channel
7' stationary channel
8 recess
9 pipe socket
10 bearing
11 rotating bushing
11' rotating bushing
12 cylindrical bore
14 pipe

What is claimed is:

1. A cylinder comprising:

at least one stationary portion and at least one rotatable portion;

a support;

the at least one rotatable portion comprising a bearing axle rotatably coupled to the support;

the at least one stationary portion comprising at least one stationary connection being relatively rotatable with respect to the bearing axle, and being adapted for at least one of inserting and removing at least one of a heating and cooling medium through the bearing axle;

a sealing device being composed of at least one brush seal and being positioned between the at least one stationary portion and the at least one rotatable portion, and the at least one brush seal being positioned between radially oriented sealing surfaces.

2. The cylinder in accordance with claim 1, the at least one brush seal being positioned between axially oriented sealing surfaces.

3. The cylinder in accordance with claim 1, the at least one brush seal comprising at least one annular brush seal.

4. The cylinder in accordance with claim 1, the at least one rotatable portion further comprising an additional rotating part adapted to rotate with the bearing axle;

the at least one stationary portion further comprising an additional stationary part adapted to be stationary with at least one stationary connection; and the at least one brush seal being positioned between one of the bearing axle and the additional rotating part and one of the at least one stationary connection and the additional stationary part.

5. The cylinder in accordance with claim 4, the at least one brush seal being positioned between axially oriented sealing surfaces.

6. The cylinder in accordance with claim 1, wherein the at least one brush seal is prestressed between the at least one stationary portion and the at least one rotatable portion.

7. The cylinder in accordance with claim 1, further comprising at least one additional seal, wherein the at least one additional seal is different than the at least one brush seal.

8. The cylinder in accordance with claim 1, the heating medium being steam, and the cylinder further comprising a condensate remover that removes condensate in the region of the at least one brush seal.

9. The cylinder in accordance with claim 1, further comprising:

at least one channel adapted to insert steam through a cylindrical bore in the bearing axle, the at least one channel extending from an interior of the cylinder outwardly through the at least one stationary connection.

10. The cylinder in accordance with claim 1, further comprising:

at least one stationary channel adapted to remove at least one of water, steam, and condensate through a cylindrical bore in the bearing axle, the at least one stationary channel extending from an interior of the cylinder outwardly through the at least one stationary connection.

11. The cylinder in accordance with claim 10, further comprising:

at least one channel adapted to insert steam through a cylindrical bore in the bearing axle, the at least one channel extending from an interior of the cylinder outwardly through the at least one stationary connection;

one of the at least one stationary channel and the at least one channel being a stationary ring channel that surrounds the other.

12. The cylinder in accordance with claim 11, the at least one channel being a stationary annular channel.

13. The cylinder in accordance with to claim 11, the at least one stationary connection being adapted for both insertion of steam and removal of at least one of water, steam, and condensate.

14. The cylinder in accordance with claim 1, further comprising two roller ends;

one of the two roller ends including one channel for inserting steam through a cylindrical bore of the bearing axle, the one channel extending from an interior of the cylinder outwardly through the at least one stationary connection.

15. The cylinder in accordance with claim 1, further comprising two roller ends;

one of the two roller ends including only one stationary channel for removing at least one of water, steam, and condensate through a cylindrical bore in the bearing axle, the one channel extending from an interior of the cylinder outwardly through the at least one stationary connection.

16. The cylinder in accordance with claim 1, further comprising two roller ends;

the at least one stationary connection comprising at least one stationary connection element coupled to each of the two roller ends;

one of the two roller ends further being coupled to a channel for inserting steam;

the other of the the two roller ends further being coupled to a stationary channel for removing at least one of water, steam, and condensate.

17. The cylinder in accordance with claim 1, further comprising:

a cylindrical pipe extending through a cylindrical bore in the bearing axle;

at least one channel extending through the cylindrical pipe.

18. The cylinder in accordance with claim 1, further comprising two roller ends;

the bearing axle having an extension shaft located on each of the two roller ends.

19. The cylinder in accordance with claim 1, the cylinder adapted for use as one of a dryer cylinder, a press roller, and a glazing cylinder in a machine for the manufacture and/or treatment of at least one of paper, textile, and other fiber webs.

20. The cylinder in accordance with claim 1, the cylinder being at least one of a heatable and coolable cylinder.

21. A cylinder comprising:

at least one stationary portion and at least one rotatable portion;

a support;

the at least one rotatable portion comprising a bearing axle rotatably coupled to the support;

the at least one stationary portion comprising at least one stationary connection being relatively rotatable with respect to the bearing axle, and being adapted for at least one of inserting and removing at least one of a heating and cooling medium through the bearing axle;

a sealing device being composed of at least one brush seal and being positioned between the at least one stationary portion and the at least one rotatable portion;

the at least one brush seal being positioned between radially oriented sealing surfaces;

the at least one rotatable portion further comprising a cylindrical pipe and a bushing being coupled to the bearing axle; and the sealing device being positioned between the at least one stationary connection and one of the cylindrical pipe and the bushing.

22. A cylinder comprising:

at least one stationary portion and at least one rotatable portion;

a support;

the at least one rotatable portion comprising a bearing axle rotatably coupled to the support;

the at least one stationary portion comprising at least one stationary connection being relatively rotatable with respect to the bearing axle, and being adapted for at least one of inserting and removing at least one of a heating and cooling medium through the bearing axle;

a sealing device being composed of at least one brush seal and being positioned between the at least one stationary portion and the at least one rotatable portion;

the at least one brush seal being positioned between radially oriented sealing surfaces;

a cylindrical bore formed in the bearing axle adapted for conveying the at least one of the heating and cooling medium;

a cylindrical pipe fixedly coupled to the bearing axle being arranged to extend through the cylindrical bore; and an end region of the cylindrical pipe being arranged to extend beyond the bearing axle and being surrounded by the at least one stationary connection.

23. The cylinder in accordance with claim 22, the cylindrical pipe adapted to be a protective pipe.

24. The cylinder in accordance with to claim 22, the at least one brush seal being positioned between an outer surface of the end region of the cylindrical pipe and the at least one stationary connection.

25. The cylinder in accordance with claim 24, further comprising:

a bushing fixedly coupled to the bearing axle and surrounding the end region of the cylindrical pipe; and the at least one brush seal being positioned between the stationary connection and the bushing.

26. The cylinder in accordance with claim 25, wherein a space located between the bearing axle and the cylindrical pipe is sealed relative to the outside by the bushing.

27. The cylinder in accordance with claim 24, the at least one brush seal being positioned directly between the outer surface of the end region of the cylindrical pipe and the stationary connection.

28. The cylinder in accordance with to claim 24, further comprising:

a bushing fixedly coupled to the bearing axle and surrounding the end region of the cylindrical pipe, and axially located between the at least one brush seal and axial end of the bearing axle.

29. The cylinder in accordance with claim 28, wherein a space located between the bearing axle and the cylindrical pipe is sealed relative to the outside by the bushing.

30. A method for sealing an end of a cylinder comprising:

rotatably coupling a bearing axle of a rotatable cylinder to a support, the bearing axle being fixedly coupled to a rotatable member and including a channel adapted for at least one of insertion and removal of at least one of a heating and a cooling medium through the bearing axle;

coupling at least one stationary connection to the bearing axle for relative rotation; and positioning at least one brush seal between radially oriented sealing surfaces between the at least one stationary connection and the rotatable member.

31. The method in accordance with claim 30, further comprising:

inserting steam into the rotatable cylinder through at least a portion of the at least one stationary connection and through the bearing axle.

32. The method in accordance with claim 30, further comprising:

removing at least one of water, steam, and condensate from the rotatable cylinder through the bearing axle and through at lease a portion of the at least one stationary connection.

33. The method in accordance with claim 32, further comprising:

inserting steam into the rotatable cylinder through at least a portion of the at least one stationary connection and through the bearing axle.

34. The method in accordance with claim 33, wherein the inserting and removing are performed at a same end of the rotatable cylinder.

35. The method in accordance with claim 33, wherein the inserting and removing are performed at opposite ends of the rotatable cylinder.

36. A method for sealing an end of a cylinder comprising:

rotatably coupling a bearing axle of a rotatable cylinder to a support, the bearing axle being fixedly coupled to a rotatable member and including a channel adapted for at least one of insertion and removal of at least one of a heating and a cooling medium through the bearing axle;

coupling at least one stationary connection to the bearing axle for relative rotation;

positioning at least one brush seal between radially oriented sealing surfaces between the at least one stationary connection and the rotatable member;

wherein the rotatable member comprises a cylindrical pipe inserted into a cylindrical bore in the bearing axle, an end of the cylindrical pipe extends beyond an axial extent of the bearing axle opposite the rotatable cylinder, and the method further comprises:

surrounding the end of the cylindrical pipe with the at least one stationary connection; and positioning the at least one brush seal between the at least one stationary connection and the end of the cylindrical pipe.

37. The method in accordance with claim 36, further comprising:

surrounding the end of the cylindrical pipe with a bushing; and sealing an outside surface of the end of the cylindrical pipe to the bearing axle with the bushing.

38. The method in accordance with claim 37, further comprising positioning the at least one brush seal between the at least one stationary connection and the bushing.

39. The method in accordance with claim 37, further comprising positioning the at least one brush seal directly between the at least one stationary connection and the outside surface of the cylindrical pipe.

* * * * *